US005834397A

United States Patent [19]

Yamazaki et al.

[11] Patent Number: 5,834,397

[45] Date of Patent: Nov. 10, 1998

[54] THERMAL TRANSFER IMAGE-RECEIVING SHEET

[75] Inventors: Masayasu Yamazaki; Satoru Kawai; Kenichiro Suto, all of Tokyo-to, Japan

[73] Assignee: Dai Nippon Printing Co., Ltd., Japan

[21] Appl. No.: 710,535

[22] Filed: Sep. 19, 1996

[30] Foreign Application Priority Data

Sep. 19, 1995 [JP] Japan ..... 7-263641

[51] Int. Cl.[6] ..... B41M 5/035; B41M 5/38

[52] U.S. Cl. ..... 503/227; 428/195; 428/500; 428/522; 428/913; 428/914

[58] Field of Search ..... 8/471; 428/195, 428/913, 914, 500, 522; 503/227

[56] References Cited

U.S. PATENT DOCUMENTS 4,720,480 1/1988 Ito et al. ..... 503/227

5,209,962 5/1993 Sakai ..... 428/195

FOREIGN PATENT DOCUMENTS

A 0 228835 7/1987 European Pat. Off. ..... 428/484

A 0 405248 1/1991 European Pat. Off. ..... 503/227

*Primary Examiner*—Bruce H. Hess

*Attorney, Agent, or Firm*—Parkhurst & Wendel, L.L.P.

[57] ABSTRACT

There is provided a thermal transfer image-receiving sheet comprising: a substrate sheet; and a receptive layer provided on at least one side of the substrate sheet, the receptive layer being formed of a receptive layer-constituting resin containing an ethylene terpolymer selected from an ethylene/vinyl acetate/polar group-containing monomer terpolymer and an ethylene/acrylic ester/polar group-containing monomer terpolymer.

3 Claims, No Drawings

THERMAL TRANSFER IMAGE-RECEIVING SHEET

BACKGROUND OF THE INVENTION

1. Field of the Invention

This invention relates to an image-receiving sheet for thermal transfer recording. More particularly, the present invention relates to a thermal transfer image-receiving sheet which, when used in printing under high speed and high energy conditions particularly in thermal dye transfer recording, can provide an image having high density and, at the same time, can prevent matting of the surface of a receptive layer.

2. Background Art

Various thermal transfer recording systems are known in the art. Among them, a thermal dye transfer system, wherein a thermal transfer sheet comprising a support, such as a polyester film, bearing a thermal transfer layer containing a sublimable dye is heated by means of a heating medium, such as a thermal head or a laser beam, to form an image on a thermal transfer image-receiving sheet, have recently drawn attention and have been utilized as information recording means in various fields.

This thermal dye transfer system can form, in very short time, a full-color image having excellent halftone reproduction and gradation and a high quality comparable to that of full-color photographic images.

Further, according to this system, since a resin constituting the image-receiving layer is dyed with a dye to form an image, the formed image advantageously has high sharpness and excellent transparency and, hence, has been extensively used in the preparation of transparent originals for projectors, such as overhead projectors (hereinafter abbreviated to "OHP").

The conventional image-receiving sheet for OHP comprises an about 100 μm-thick transparent substrate sheet of polyethylene terephthalate (hereinafter abbreviated to "PET") bearing an image-receiving layer on one side thereof and a backside layer on the other side thereof.

The image-receiving layer functions to receive a sublimable dye being transferred from a thermal transfer sheet and to hold the formed image and is formed of a thermoplastic resin, for example, a saturated polyester resin, E vinyl chloride/vinyl acetate copolymer, or a polycarbonate resin. If necessary, at an intermediate layer is provided on the image-receiving layer side of the substrate.

For example, a layer for imparting a cushioning property in the case of a highly rigid substrate, such as PET, and a layer for imparting an antistatic property are optionally provided as the intermediate layer.

The backside layer functions to prevent curling and to improve the slipperliness of the image-receiving sheet and is formed by coating a composition containing a binder, such as an acrylic resin, with an organic filler, such as an acrylic resin, a fluororesin, or a polyamide rein, or an inorganic filler, such as silica, incorporated therein.

On the other hand, in the case of the so-called "standard type thermal transfer image-receiving sheet," the image-receiving sheet is viewed or used by taking advantage of reflected light rather than transmitted light. The construction of this standard type thermal transfer image-receiving sheet is substantially the same as that of the above thermal transfer image-receiving sheet, except that, the substrate is constituted by an opaque material, for example, white PET, foamed PET, other plastic sheet, natural paper, synthetic paper, or a laminate thereof.

In recent years, an increase in printing speed of a thermal transfer printer has posed a problem that conventional thermal transfer recording materials cannot provide satisfactory print density. In order to provide satisfactory density, it is necessary to increase the sensitivity in printing of the receptive layer or to increase the printing energy. One method for increasing the sensitivity in printing of the receptive layer is to add a sensitizer, and a representative sensitizer for this purpose is a plasticizer.

Plasticizers usable as the sensitizer include those commonly used for vinyl chloride resin, for example, monomeric plasticizers, such as phthalic esters, phosphoric esters, adipic esters, and sebacic esters, and polyester acid plasticizers prepared by polymerizing adipic acid, sebacic acid or the like with propylene glycol. These plasticizers, however, have low molecular weight (several hundreds to several thousands) and are generally liquid. When they are used in a thermal transfer image-receiving sheet, the thermal transfer image-receiving sheet is likely to change with the elapse of time and to undergo deformation by heat, posing a problem that damage to the receptive layer upon heating at the time of printing results in matting (roughening) of the surface of the receptive layer.

Further, increasing the printing energy also has resulted in damage to the surface of the receptive layer in its high density area by the heat, leading to matting of the surface of the receptive layer. In particular, in the case of an image-receiving sheet for OHP, a high density is required of a transparent print in order to provide satisfactory dynamic range (three-dimensional effect and design) in the projection of the image, and, for this reason, higher energy is applied to a high-density print area, causing significant matting of the surface of the receptive layer. The matting results in scattering of light which is transmitted or reflected at the time of projection through OHP, so that the projected image is blackish.

Further, in the case of thermal transfer image-receiving sheets for OHP or of the standard type, satisfactory energy cannot be applied from the viewpoint of avoiding this problem of matting, making it impossible to provide necessary printing density.

The present invention has been made with a view to solving the above problem of the prior art, and an object of the present invention is to provide a thermal transfer image-receiving sheet which, when used in printing under high speed and high energy conditions, can provide an image having high density and, at the same time, can prevent matting of the surface of a receptive layer.

SUMMARY OF THE INVENTION

According to the present invention, the above object can be attained by a thermal transfer image-receiving sheet comprising: a substrate sheet; and a receptive layer provided on at least one side of the substrate sheet, the receptive layer being formed of a receptive layer-constituting resin containing an ethylene terpolymer selected from an ethylene/vinyl acetate/polar group-containing monomer terpolymer and an ethylene/acrylic ester/polar group-containing monomer terpolymer.

According to the thermal transfer image-receiving sheet of the present invention, the specific ethylene terpolymer contained in the receptive layer has good compatibility with the receptive layer-constituting resin, particularly vinyl chloride resin and vinyl chloride/vinyl acetate copolymer resin, and functions as a plasticizer for these resins, resulting in enhanced sensitivity in printing of the receptive layer.

Further, the ethylene terpolymer generally has a very high molecular weight of not less than 250000, and, hence, unlike conventional liquid plasticizers, has no fear of change with the elapse of time and can prevent matting of the surface of the receptive layer in printing at high energy.

DETAILED DESCRIPTION OF THE INVENTION

Embodiments of the thermal transfer sheet of the present invention will be described.

Substrate sheet

The substrate sheet functions to support a receptive layer and, preferably, is not deformed by heat applied at the time of thermal transfer and has mechanical strength high enough to cause no trouble when handled in a printer or the like. Materials for constituting the substrate sheet are not particularly limited, and examples thereof include films of various plastics, for example, polyesters, polyacrylates, polycarbonates, polyurethane, polyimides, polyetherimides, cellulose derivatives, polyethylene, ethylene/vinyl acetate copolymer, polypropylene, polystyrene, polyacrylonitrile, polyvinyl chloride, polyvinylidene chloride, polyvinyl alcohol, polyvinyl butyral, nylon, polyetheretherketone, polysulfone, polyethersulfone, tetrafluoroethylene/perfluoroalkyl vinyl ether copolymer, polyvinyl fluoride, tetrafluoroethylene/ethylene copolymer, tetrafluoroethylene/hexafluoropropylene copolymer, polychlorotrifluoroethylene, and polyvinylidene fluoride. Among them, transparent sheets may be used as the substrate of the thermal transfer image-receiving sheet for OHP applications.

In the case of the standard type thermal transfer image-receiving sheet, it is possible to use, besides the above films, a white opaque film, prepared by adding a white pigment or a filler to the above synthetic resin and forming the mixture into a sheet, and a foamed sheet. Further, various types of papers, such as capacitor paper, glassine paper, parchment paper, synthetic papers (such as polyolefin and polystyrene papers), wood free paper, art paper, coat paper, cast coated paper, paper impregnated with a synthetic resin or an emulsion, paper impregnated with a synthetic rubber latex, paper with a synthetic resin internally added thereto, and cellulose fiber paper.

Furthermore, laminates of any combination of the above substrate sheets may also be used. Representative examples of the laminate include a laminate of cellulose fiber paper and synthetic paper and a laminate of cellulose fiber paper and a synthetic paper of a plastic film.

Furthermore, at least one side of the above substrate sheets may have been subjected to treatment for improving the adhesion.

Preferably, the substrate sheet has a surface resistivity of not more than $1.0\times10^{12}$ Ω□ under an environment of temperature 20° C. and relative humidity 50%. Such a substrate sheet may be selected from the above materials. Alternatively, the materials may be subjected to antistatic treatment to bring the surface resistivity to the above value. The use of the substrate sheet having the above surface resistivity can prevent troubles caused by static electricity during the production of the image-receiving sheet and, at the same time, can enhance the effect of an antistatic agent, described below, coated on the image-receiving surface and/or the back surface of the thermal transfer image-receiving sheet.

The thickness of the substrate sheet is generally about 3 to 300 μm. It, however, is preferably 75 to 175 μm from the viewpoint of mechanical properties and other properties. If the substrate sheet has poor adhesion to a layer provided thereon, the surface thereof may be subjected to adhesiveness-improving treatment or corona discharge treatment.

Receptive layer

The thermal transfer image-receiving sheet of the present invention is characterized in that the receptive layer contains an ethylene terpolymer selected from an ethylene/vinyl acetate/polar group-containing monomer terpolymer and an ethylene/acrylic ester/polar group-containing monomer terpolymer. Examples of the polar group-containing monomer include acrylic acid, methacrylic acid, acrylonitrile, methacrylonitrile, acrylamide, methacrylamide, N-methylolacrylamide, N-ethanolacrylamide, N-propanolacrylamide, N-methacrylamide, N-ethanolmethacrylamide, N-methylacrylamide, N-tert-butylacrylamide, hydroxyethyl methacrylate, glycidyl acrylate, glycidyl methacrylate, and dimethylaminoethyl methacrylate. Among all, acrylic acid and methacrylic acid are preferred. The acrylic ester may be an alkyl ester of acrylic or methacrylic acid. The alkyl group in the ester generally has 1 to 10 carbon atoms, preferably 1 to 4 carbon atoms. The ethylene terpolymer has an ethylene content of generally 50 to 80% by weight and a polar group-containing monomer content of generally 0.01 to 20% by weight, preferably 1 to 10% by weight. This ethylene terpolymer has good compatibility particularly with vinyl chloride resin ox vinyl chloride/vinyl acetate copolymer resin and functions as a plasticizer which has an effect comparable to that of known liquid plasticizers. Further, the ethylene terpolymer generally has a very high molecular weight of not less than 250000, and, hence, unlike conventional liquid plasticizers, has no fear of change with the elapse of time and can prevent matting of the surface of the receptive layer in printing at high energy. The ethylene terpolymer can be added in an amount of about 100% by weight to the receptive layer-constituting resin with the addition of the ethylene terpolymer in an amount of 10 to 60% by weight being preferred from the viewpoint of storage stability of prints. If necessary, the ethylene terpolymer may be used in combination with a conventional liquid plasticizer. In this case, the amount of the conventional liquid plasticizer should be preferably such that the advantage of the present invention is not lost.

According to the thermal transfer image-receiving sheet of the present invention, preferably, the receptive layer-constituting resin is composed mainly of at least one member selected from vinyl chloride resin and vinyl chloride/vinyl acetate copolymer resin. This is because, as described above, the compatibility of the ethylene terpolymer with these resins is so good that the sensitivity in printing of the receptive layer can be enhanced.

In the thermal transfer image-receiving sheet according to the present invention, the receptive layer may be formed of a mixture of the above components with other thermoplastic resin(s). Thermoplastic resins usable herein include polyolefin resins such as polypropylene; halogenated polymers such as polyvinylidene chloride; vinyl resins such as polyvinyl acetate, ethylene/vinyl acetate copolymer, and polyacrylic esters; polyester resins; polystyrene resins; polyamide resins; olefin/vinyl monomer copolymer resins; ionomers; cellulosic resins such as cellulose diacetate; polycarbonate resins; polyvinyl acetal resins; and polyvinyl alcohol resins. When the above mixture is used and particularly when the thermal transfer image-receiving sheet is used in applications, where transparency is necessary, such as OHP, a resin having good compatibility should be selected.

If necessary, various other additives may be added. For example, a release agent may be added so that the thermal transfer sheet and the thermal transfer image-receiving sheet are not heat-fused to each other at the time of printing. Catalyst-curable silicones and reaction-curable silicones, such as amino-modified silicone and epoxy-modified silicone, may be mentioned as particularly preferred release agents. The amount of the release agent added is preferably 0.5 to 10% by weight based on the resin.

Further, pigments and fillers, such as titanium oxide, zinc oxide, kaolin, clay, calcium carbonate, and finely divided silica, may be added from the viewpoint of enhancing the whiteness of the receptive layer and further enhancing the sharpness of the transferred image. In this case, however, when the use of the thermal transfer image-receiving sheet in applications, where transparency is necessary, such as OHP, is contemplated, the amount of the pigment or filler added should be such that the necessary transparency is not lost.

The receptive layer may be formed by adding the above optional additives and the like to the above resin and ethylene terpolymer, thoroughly kneading them in a solvent, a diluent or the like to prepare a coating liquid for a receptive layer, coating the coating liquid onto the above substrate sheet, for example, by gravure printing, screen printing, or reverse roll coating using a gravure plate, and drying the coating to form a receptive layer.

The intermediate layer, backside layer, and antistatic layer described below may be formed in the same manner as described above in connection with the formation of the receptive layer.

Further, in order to impart an antistatic property, it is also possible to incorporate the following antistatic agent into a coating liquid for a receptive layer: fatty acid esters, sulfuric esters, phosphoric esters, amides, quaternary ammonium salts, betaine, amino acids, acrylic resins, ethylene oxide adducts and the like.

The amount of the antistatic agent added is preferably 0.1 to 2.0% by weight based on the resin.

In the thermal transfer image-receiving sheet according to the present invention, the coating liquid for a receptive layer is coated at a coverage of 0.5 to 4.0 g/m$^3$ on a dry weight basis. When the coverage is less than 0.5 g/m$^2$ on a dry weight basis, for example, when a receptive layer is provided directly on the substrate sheet, the adhesion of the receptive layer to the thermal head is likely to be unsatisfactory due to the rigidity of the substrate sheet or the like, posing a problem of harsh image in its highlight area. This problem can be avoided by providing an intermediate layer for imparting a cushioning property. This means, however, deteriorates the scratch resistance of the receptive layer. There is a tendency that the surface roughening resistance of the receptive layer upon the application of high energy decreases relatively with increasing the coverage of the receptive layer. When the coverage exceeds 4.0 g/m$^2$ on a dry weight basis, the high-density area projected through OHP is sometimes slightly blackish.

The coverage described below in connection with the present invention is on a dry weight basis in terms of solid content unless otherwise specified.

Intermediate layer

In the thermal transfer image-receiving sheet according to the present invention, an intermediate layer formed of various resins may be provided between the substrate sheet and the receptive layer. Excellent functions may be added to the thermal transfer image-receiving sheet by imparting various properties to the intermediate layer.

For example, a resin having large elastic deformation or plastic deformation, for example, a polyolefin, vinyl copolymer, polyurethane, or polyamide resin, may be used as a resin for imparting a cushioning property in order to improve the sensitivity in printing of the thermal transfer image-receiving sheet or to prevent harsh images. Further, when the intermediate layer is provided using a resin having a glass transition temperature of 60° C. or above or a resin that has been cured with a curing agent or the like, the adhesion between sheets can be prevented when a plurality of sheets of the thermal transfer image-receiving sheet are stored with the sheets being put on top of one another, thereby improving the storage stability of the thermal transfer image-receiving sheet.

When an antistatic property is imparted to the intermediate layer, the intermediate layer may be prepared by dissolving or dispersing the above resin, with an antistatic agent or a resin having an antistatic property added thereto, in a solvent and coating the solution or the dispersion to form an intermediate layer.

Antistatic agents usable herein include, for example, fatty acid esters, sulfuric esters, phosphoric esters, amides, quaternary ammonium salts, betaine, amino acids, acrylic resins, and ethylene oxide adducts.

Resins having an antistatic property usable herein include, for example, conductive resins prepared by introducing a group having an antistatic effect, such as a guaternary ammonium salt, phosphoric acid, ethosulfate, vinyl pyrrolidone, or sulfonic acid group, into a resin, such as an acrylic, vinyl, or cellulose resin, or alternatively by copolymerizing the above resin with the above group having an antistatic effect. A cation-modified acrylic resin is particularly preferred.

Preferably, the group having an antistatic effect is introduced in a pendant form into the resin from the viewpoint of introducing the group at a high density. Specific examples of commercially available antistatic resins include Jurymer series manufactured by Nihon Junyaku Co., Ltd., Reolex series manufactured by Dai-Ichi Kogyo Seiyaku Co., Ltd., and Elecond series manufactured by Soken Chemical Engineering Co., Ltd.

Backside layer

A backside layer may be provided on the side of the substrate sheet, remote from the receptive layer, for purposes of improvement in carriability of the thermal transfer image-receiving sheet, prevention of curling of the sheet, or other purposes. The backside layer having such a function may be formed of an acrylic resin with an organic filler, such as a fluororesin or a polyamide resin.

Preferably, the backside layer is formed of a composition containing an acrylic polyol and fine particles of an organic material.

Acrylic polyols usable herein include polymers, such as ethylene glycol methacrylate and propylene glycol methacrylate. Further, acrylic polyols wherein the ethylene glycol moiety is trimethylene glycol, butanediol, pentanediol, hexanediol, cyclopentanediol, cyclohexanediol, or glycerin may also be used. The acrylic polyol contributes to prevention of curling, can hold additives such as organic or inorganic fillers, and has good adhesion to the substrate.

More preferably, the backside layer is formed of a cured product prepared by curing an acrylic polyol with a curing agent. The curing agent may be a generally known one. Among others, the use of an isocyanate compound is preferred. The reaction of the acrylic polyol with an isocyanate compound results in the formation of a urethane bond to cure the acrylic polyol, thereby forming a stereostructure to improve the heat resistance, the storage stability, and the solvent resistance. Further, it can improve the adhesion of the backside layer to the substrate sheet. The amount of the curing agent added is preferably 1 to 2 equivalents based on one reactive group equivalent of the resin.

Further, the addition of an organic filler to the backside layer is preferred. The filler functions to improve the carriability of the sheet within a printer and, at the same time, to prevent blocking or the like, thereby improving the storage stability of the sheet. Organic fillers usable herein include acrylic fillers, polyamide fillers, fluorofillers, and polyethylene wax. Among them, polyamide fillers are particularly preferred. Preferably, the polyamide filler has a molecular weight of 100,000 to 900,000 and are spherical with an average particle diameter of 0.01 to 10 $\mu$m. The polyamide filler has a high melting point, is stable against heat, has good oil resistance and chemical resistance, and is less likely to be dyed with a dye. Further, when the polyamide filler has a molecular weight of 100,000 to 900,000, it is hardly abraded, has a self-lubricating property and a low coefficient of friction, and is less likely to damage a counter material with which the backside layer is brought into friction. In the polyamide filler, nylon 12 filler is better than nylon 6 and nylon 66 fillers because it has superior water resistance and is free from any property change attributable to water absorption.

The amount of the filler added is preferably 0.05 to 200% by weight based on the resin. In this connection, it should be noted that, in the case of an image-receiving sheet, for OHP, wherein the addition of a filler deteriorates transparency of the sheet, the filler is added in an amount of not more than 2% by weight based on the resin, or a filler having a small particle diameter is selected.

Adhesive layer

An adhesive layer formed of an adhesive resin, such as an acrylic ester resin, a polyurethane resin, or a polyester resin, may be provided on at least one side of the substrate sheet.

Alternatively, at least one side of the substrate sheet may be subjected to corona discharge treatment without providing the above coating, thereby enhancing the adhesion of the substrate sheet to a layer provided on the substrate sheet.

Antistatic layer

An antistatic layer may be provided on at least one side of the substrate sheet, on the image-receiving surface or the backside of the image-receiving sheet, or on the outermost surface of each of both sides of the image-receiving sheet. The antistatic layer may be formed by dissolving or dispersing an antistatic agent, for example, a fatty acid ester, a sulfuric ester, a phosphoric ester, an amide, a quaternary ammonium salt, betaine, an amino acid, an acrylic resin, or an ethylene oxide adduct, in a solvent, coating the solution or dispersion, and drying the coating.

The coverage of the antistatic layer is preferably 0.001 to 0.1 g/m$^2$.

Since a thermal transfer image-receiving sheet having an antistatic layer on the outermost surface thereof has an antistatic property before printing, it can prevent feed troubles such as double feed. Further, troubles such as dropout caused by attraction of dust or the like can be prevented.

The following examples further illustrate the present invention but are not intended to limit it. In the following examples and comparative examples, all "parts" are by weight unless otherwise specified.

EXAMPLE 1

A 100 $\mu$m-thick transparent polyethylene terephthalate film (Lumirror, manufactured by Toray Industries, Inc.) was provided as a substrate sheet. A coating liquid 1, for a receptive layer, having the following composition was coated on the substrate sheet by roll coating at a coverage of 3.5 g/m$^2$ on a dry basis and the coating was dried to form a receptive layer, thereby preparing a thermal transfer image-receiving sheet of Example 1.

Coating liquid 1 for receptive layer

Vinyl chloride/vinyl acetate copolymer 85 parts resin (#1000 AKT, manufactured by Denki Kagaku Kogyo K.K.)

Ethylene terpolymer A (ELVALOY 741, 15 parts manufactured by Du Pont-Mitsui Polychemicals Co., Ltd.)

Amino-modified silicone (KF-393, 3 parts manufactured by The Shin-Etsu Chemical Co., Ltd.)

Epoxy-modified silicone (X-22-343, 3 parts manufactured by The Shin-Etsu Chemical Co., Ltd.)

Toluene 300 parts

Methyl ethyl ketone 300 parts

EXAMPLE 2

A thermal transfer image-receiving sheet of Example 2 was prepared in the same manner as in Example 1, except that a coating liquid 2, for a receptive layer, having the following composition was used instead of the coating liquid 1.

Coating liquid 2 for receptive layer

Vinyl chloride/vinyl acetate copolymer 70 parts resin (#1000 AKT, manufactured by Denki Kagaku Kogyo K.K.)

Ethylene terpolymer A (ELVALOY 741, 30 parts manufactured by Du Pont-Mitsui Polychemicals Co., Ltd.)

Amino-modified silicone (KF-393, 3 parts manufactured by The Shin-Etsu Chemical Co., Ltd.)

Epoxy-modified silicone (X-22-343, 3 parts manufactured by The Shin-Etsu Chemical Co., Ltd.)

Toluene 300 parts

Methyl ethyl ketone 300 parts

EXAMPLE 3

A thermal transfer image-receiving sheet of Example 3 was prepared in the same manner as in Example 1, except that a coating liquid 3, for a receptive layer, having the following composition was used instead of the coating liquid 1.

Coating liquid 3 for receptive layer

Vinyl chloride/vinyl acetate copolymer 70 parts resin (#1000 MT2, manufactured by Denki Kagaku Kogyo K.K.)

Ethylene terpolymer A (ELVALOY 741, 30 parts manufactured by Du Pont-Mitsui Polychemicals Co., Ltd.)

Amino-modified silicone (KF-393, 3 parts manufactured by The Shin-Etsu Chemical Co., Ltd.)

Epoxy-modified silicone (X-22-343, 3 parts manufactured by The Shin-Etsu Chemical Co., Ltd.)

Toluene 300 parts

Methyl ethyl ketone 300 parts

EXAMPLE 4

A thermal transfer image-receiving sheet of Example 4 was prepared in the same manner as in Example 1, except that a coating liquid 4, for a receptive layer, having the following composition was used instead of the coating liquid 1.

Coating liquid 4 for receptive layer

Vinyl chloride/vinyl acetate copolymer 70 parts resin (#1000 AKT, manufactured by Denki Kagaku Kogyo K.K.)

Ethylene terpolymer B (ELVALOY EP4043, 30 parts manufactured by Du Pont-Mitsui Polychemicals Co., Ltd.)

Amino-modified silicone (KF-393, 3 parts manufactured by The Shin-Etsu Chemical Co., Ltd.)

Epoxy-modified silicone (x-22-343, 3 parts manufactured by The Shin-Etsu Chemical Co., Ltd.)

Toluene 300 parts

Methyl ethyl ketone 300 parts

Comparative Example 1

A thermal transfer image-receiving sheet of Comparative Example 1 was prepared in the same manner as in Example 1, except that a coating liquid 5, for a receptive layer, having the following composition was used instead of the coating liquid 1.

Coating liquid 5 for receptive layer

Vinyl chloride/vinyl acetate copolymer 100 parts resin (#1000 AKT, manufactured by Denki Kagaku Kogyo K.K.)

Amino-modified silicone (KF-393, 3 parts manufactured by The Shin-Etsu Chemical Co., Ltd.)

Epoxy-modified silicone (X-22-343, 3 parts manufactured by The Shin-Etsu Chemical Co., Ltd.)

Toluene 300 parts

Methyl ethyl ketone 300 parts

Comparative Example 2

A thermal transfer image-receiving sheet of Comparative Example 2 was prepared in the same manner as in Example 1, except that a coating liquid 6, for a receptive layer, having the following composition was used instead of the coating liquid 1.

Coating liquid 6 for receptive layer

Vinyl chloride/vinyl acetate copolymer 100 parts resin (#1000 MT2, manufactured by Denki Kagaku Kogyo K.K.)

Amino-modified silicone (KF-393, 3 parts manufactured by The Shin-Etsu Chemical Co., Ltd.)

Epoxy-modified silicone (X-22-343, 3 parts manufactured by The Shin-Etsu chemical Co., Ltd.)

Toluene 300 parts

Methyl ethyl ketone 300 parts

Comparative Example 3

A thermal transfer image-receiving sheet of Comparative Example 3 was prepared in the same manner as in Example 1, except that a coating liquid 7, for a receptive layer, having the following composition was used instead of the coating liquid 1.

Coating liquid 7 for receptive layer

Vinyl chloride/vinyl acetate copolymer 70 parts resin (#1000 ART, manufactured by Denki Kagaku Kogyo K.K.)

Plasticizer (dioctyl phthalate; 30 parts abbreviated to "DOP")

Amino-modified silicone (KF-393, 3 parts manufactured by The Shin-Etsu Chemical Co., Ltd.)

Epoxy-modified silicone (X-22-343, 3 parts manufactured by The Shin-Etsu Chemical Cc., Ltd.)

Toluene 300 parts

Methyl ethyl ketone 300 parts

Comparative Example 4

A thermal transfer image-receiving sheet of Comparative Example 4 was prepared in the same manner as in Example 1, except that a coating liquid 8, for a receptive layer, having the following composition was used instead of the coating liquid 1.

Coating liquid 8 for receptive layer

Vinyl chloride/vinyl acetate copolymer 70 parts resin (#1000 AKT, manufactured by Denki Kagaku Kogyo K.K.)

Polyester plasticizer (PN-310, manufactured 30 parts by Asahi Denka Kogyo K.K.)

Amino-modified silicone (KF-393, 3 parts manufactured by The Shin-Etsu Chemical Co., Ltd.)

Epoxy-modified silicone (X-22-343, 3 parts manufactured by The Shin-Etsu Chemical Co., Ltd.)

Toluene 300 parts

Methyl ethyl ketone 300 parts

Evaluation

Each of the thermal transfer image-receiving sheets prepared in the examples and the comparative examples and a commercially available thermal dye transfer sheet were put on top of the other so that the receptive layer faced the dye layer, and heating was carried out from the backside of the thermal transfer sheet by means of a thermal head.

In the printing, a printer which is equipped with a 300-dpi (line density) thermal head and can conduct regulation of 256 gradations was provided. A 16-step pattern with equally divided 256 gradation values (ranging from 0 to 255) was prepared, using this printer, for each color of yellow, magenta, and cyan and black formed by overprinting three colors of yellow, magenta, and cyan. The printing was carried out under conditions of printing speed 10 ms/line and maximum applied thermal energy 0.65 mJ/dot in the 16th step image.

The evaluation was performed for the 16th step image of each color. The print density was measured with a Macbeth transmission densitometer, and matting of the surface of the receptive layer was judged by visually inspecting whether or not a projected image produced through OHP is blackish. The evaluation criteria are as follows.

⊙: Neither blackening of projected image nor matting observed for each color.

○: Blackening of projected image not observed, although matting observed for only black color.

Δ: Matting observed for each color, and slight blackening of projected image observed for each color.

x: Matting of projected image observed in the 16th and even in lower step images, and blacking of projected image observed for each color.

Results of evaluation

The results of evaluation are summarized in Table 1.

TABLE 1

| | Transmission density | Matting |
|---|---|---|
| Example 1 | 1.45 | ○ |
| Example 2 | 1.60 | ◎ |
| Example 3 | 1.62 | ◎ |
| Example 4 | 1.59 | ◎ |
| Comparative Example 1 | 1.23 | Δ |
| Comparative Example 2 | 1.25 | Δ |
| Comparative Example 3 | 1.59 | x |
| Comparative Example 4 | 1.48 | x |

Comparison of the results of Examples 1 to 4 with those of Comparative Examples 1 to 4 shows that the receptive layers using the ethylene terpolymers according to the present invention exhibited higher print density and better results on mattering as compared with the receptive layers of the comparative examples.

What is claimed is:

1. A thermal transfer image-receiving sheet comprising: a substrate sheet; and a receptive layer provided on at least one side of the substrate sheet, the receptive layer being formed of a receptive layer-constituting resin and an ethylene terpolymer selected from an ethylene/vinyl acetate/polar group-containing monomer terpolymer and an ethylene/acrylic ester/polar group-containing monomer terpolymer, said receptive layer-constituting resin comprising at least one member selected from vinyl chloride resin and vinyl chloride/vinyl acetate copolymer resin.

2. The thermal transfer image-receiving sheet according to claim 1, wherein the polar group-containing monomer is acrylic acid or methacrylic acid.

3. The thermal transfer image-receiving sheet according to claim 1, wherein the ethylene terpolymer comprises 50 to 80% by weight of ethylene and 1 to 10% by weight of the polar group-containing monomer.

* * * * *